United States Patent [19]

Forme

[11] 4,240,067

[45] Dec. 16, 1980

[54] DEVICE FOR THE TRANSMISSION BY LOAD VARIATION OF AN ALTERNATING ANALOG SIGNAL FROM A SENSOR

[75] Inventor: Jacques Forme, Paris, France

[73] Assignee: Societe Chauvin Arnoux, Paris, France

[21] Appl. No.: 29,440

[22] Filed: Apr. 12, 1979

[30] Foreign Application Priority Data

Apr. 18, 1978 [FR] France ..... 78 11352

[51] Int. Cl.[3] ..... G08C 19/10

[52] U.S. Cl. ..... 340/870.37; 340/870.30; 340/870.39

[58] Field of Search ..... 340/200, 210, 186, 177 R, 340/177 VC, 177 VA, 191; 324/61 R

[56] References Cited

U.S. PATENT DOCUMENTS

| | | | |
|---|---|---|---|
| 3,646,538 | 2/1972 | Frick | 340/200 |
| 3,975,719 | 8/1976 | Frick | 340/200 |

*Primary Examiner*—Thomas A. Robinson

[57] ABSTRACT

Device for transmitting an alternating analog signal from a sensor to a measurement room remote from the sensor, comprising a preamplifier situated in the vicinity of the sensor for preamplifying the output signal thereof, a line with two conductors, a measuring circuit receiving through the line the preamplified signal, a circuit for supplying power to the preamplifier, a circuit for checking the proper operation of the device and a circuit for modifying the gain of the preamplifier. The line transmits simultaneously the DC supply current, a checking signal in the form of an alternating voltage, a gain modification signal by modifying the level of the DC supply current and the measuring signal by a charge variation generated by an electric charge generator inserted between the preamplifier and the line. A DC current absorber is inserted between the output of the charge generator and the supply terminal of the preamplifier.

6 Claims, 4 Drawing Figures

DEVICE FOR THE TRANSMISSION BY LOAD VARIATION OF AN ALTERNATING ANALOG SIGNAL FROM A SENSOR

BACKGROUND OF THE INVENTION

1. Field of the Invention

The present invention relates to a device for transmitting an alternating analog signal from a sensor to a measurement room remote from the sensor, comprising a measuring preamplifier located in the vicinity of the sensor for providing a preamplified signal from the analog signal of the sensor, a transmission line having two conductors for conveying the preamplified signal to the measurement room, an electronic measuring circuit located in the measurement room and receiving the transmitted preamplified signal for providing an output signal representing the signal from the sensor, and a power supply circuit located in the measurement room and comprising a constant DC current generator connected to supply terminals of the measuring preamplifier through the transmission line.

A sensor such as a piezoelectric quartz gives a low level alternating analog signal and preamplification is required if the transmission line is of a length possibly reaching a few kilometers.

To overcome the problem of attenuation which the resistance of the line would cause in a voltage transmission, current transmission is often used as shown in FIG. 1 of the accompanying drawings.

2. Description of the Prior Art

In FIG. 1, there is shown at 10 a piezoelectric type sensor connected by a cable 11, preferably of the screened type, to the input of a preamplifier 20. The preamplifier is here of the electric charge amplifier type, with a feedback capacitor 21, so as to be adapted to the nature of the signal from sensor 10.

The preamplifier 20 is situated at an offset location in the vicinity of the sensor 10, in an area which may be difficult of access as in the case of a nuclear power station.

There is shown at 30 an electronic circuit transforming the preamplified signal. Here, this signal, which is an alternating voltage, is transformed into an alternating current. The circuit 30 may be formed by a resistance 31 in series with the collector-emitter path of a transistor 32 having its base terminal 33 connected to the output 22 of the preamplifier 20. The endmost terminals 34 and 35 of the transistor 32 and resistance 31 assembly are respectively connected to the input terminals 41–42 of a transmission line 40.

The transmission line 40 conveys the preamplified signal, in current form, to a measurement room represented by a frame 1 of dash-dot lines.

An electronic measuring circuit 50 receiving the transmitted signal is formed here symbolically by a load resistance 51, a capacitor 52 letting through the alternating component of the signal and an indicator 53 giving the value of the output signal U~.

A power supply circuit comprises a constant DC current generator 60, located in the measurement room, and connected to the output terminals 43–44 of transmission line 40.

Supply terminals 23–24 of the preamplifier 20 are furthermore connected to the input terminals 41–42 of line 40, so that the preamplifier can be supplied with power from the measurement room 1 and through the transmission line 40. An intermediate reference voltage may be created by means of a divider not shown.

It can be seen that capacitor 52 serves to prevent the supply DC current from passing into indicator 53. The preamplifier 20 must also have a low and constant power consumption in relation to the current representing the transmitted signal.

It is often required to be able to check the proper operation of the transmission chain going from sensor 10 to indicator 53 of the measurement circuit. To this end, it is known to insert an alternating voltage source 70 between sensor 10 and the input of preamplifier 20, for example by means of a test switch 71.

If the offset location where the preamplifier 20 is to be found is not accessible and does not have an alternating voltage source, there may be inserted between the sensor 10 and the input of the preamplifier 20 a transformer secondary whose primary is supplied with an alternating voltage from the measurement room. But, in this case, an additional transmission line is required.

In order not to affect the output signal U~ by the checking test, it is known to use in the electronic measuring circuit 50 a differential amplifier (not shown in FIG. 1), receiving on the one hand, the output voltage of the measuring circuit 50 and, on the other hand, the voltage of the alternating source 70 (when the latter is located in the measurement room).

To prevent the noise appearing in the transmission with preamplified signals which are too weak, or to prevent saturation appearing with signals which are too strong, it is often desirable to be able to modify the gain of preamplifier 20. To this end, it is known to use a gain modification circuit 80, comprising in the case of FIG. 1 an additional feedback capacitor 81 which can be connected in parallel with feedback capacitor 21 through switch means 82.

If the offset location where the preamplifier 20 is to be found is not accessible, the switch means 82 may be a relay controlled from the measurement room. But, in this case, yet another additional line must be provided.

It can be noted that the distributed capacitance of line 40 influences the result of the measurement for a part of the measuring current is diverted by said capacitance, and this all the more so since the load resistance 51, of a not negligible value, imposes a non-zero voltage at the output terminals 43–44 of line 40.

On the other hand, to avoid voltages being induced in line 40 by other conductors through which high currents flow and which are disposed in the vicinity of line 40, it is desirable for said line to be of the screened type, and so more expensive. But, in this case, the distributed capacitance of the line is increased, which aggravates the previous shortcoming.

SUMMARY OF THE INVENTION

One object of the present invention is to provide a device for transmitting an alternating analog signal which is free of the disadvantages and limitations mentioned above.

In particular, the transmission device of the invention may use a long unscreened line, of high ohmic resistance, even in the vicinity of conductors through which flow high currents. Moreover, the transmission line only has two conductors, even in the cases where it is necessary to provide a supply circuit for the apparatuses situated in the offset location, a circuit for checking the proper operation of the transmission chain, and a gain modification circuit, the whole controlled and monitored from the measurement room.

The transmission device of the invention is characterized in that it comprises an electric charge generator inserted between the measuring preamplifier and the transmission line for generating an electric charge proportional to the preamplified signal received at its input, and in that the electric measuring circuit comprises an electric charge amplifier.

According to another feature of the invention, a constant DC current absorber is inserted between a supply terminal of the preamplifier and an output terminal of the electric charge generator, itself connected to an input terminal of the transmission line.

In a particular embodiment of the invention, the electric charge generator comprises an operational amplifier having a negative input connected by a first resistor to the output of the preamplifier, a positive input connected, on the one hand, through a second resistor in series with a first capacitor, to a first input terminal of the transmission line and, on the other hand, through a third resistor, to a second input terminal of the transmission line, and an output connected, on the one hand, through a feedback resistor, to the negative input terminal of the operational amplifier and, on the other hand, through a second capacitor, to the first input terminal of the transmission line.

Other features and advantages of the invention will be more clearly understood from the detailed description which follows, given by way of a non-limiting example.

DESCRIPTION OF THE PREFERRED EMBODIMENTS

Figure 1:
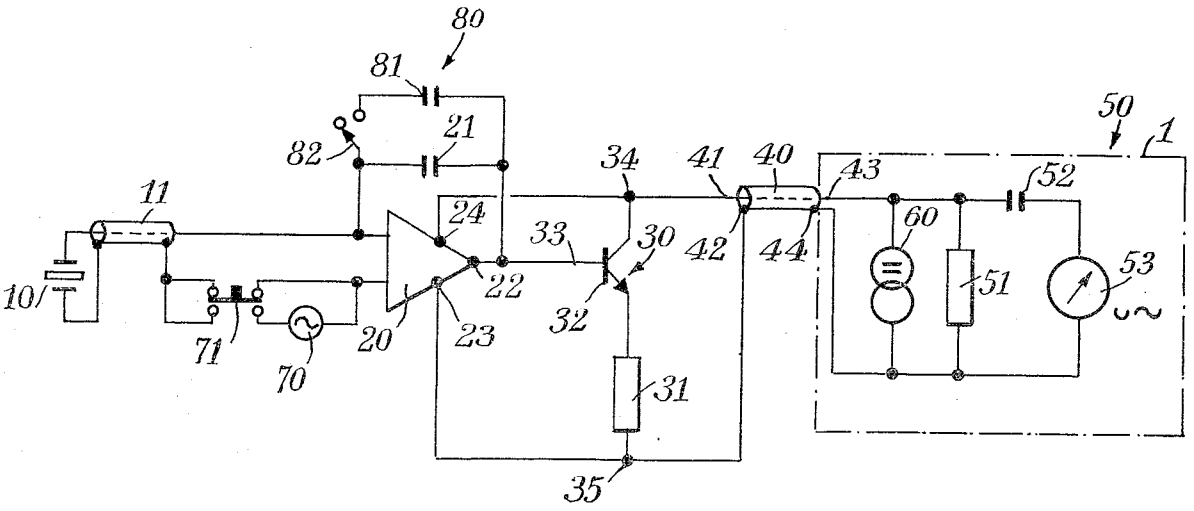
Fig. 1 PRIOR ART
FIG. 1 is a diagram of a known transmission device.
Figure 2:
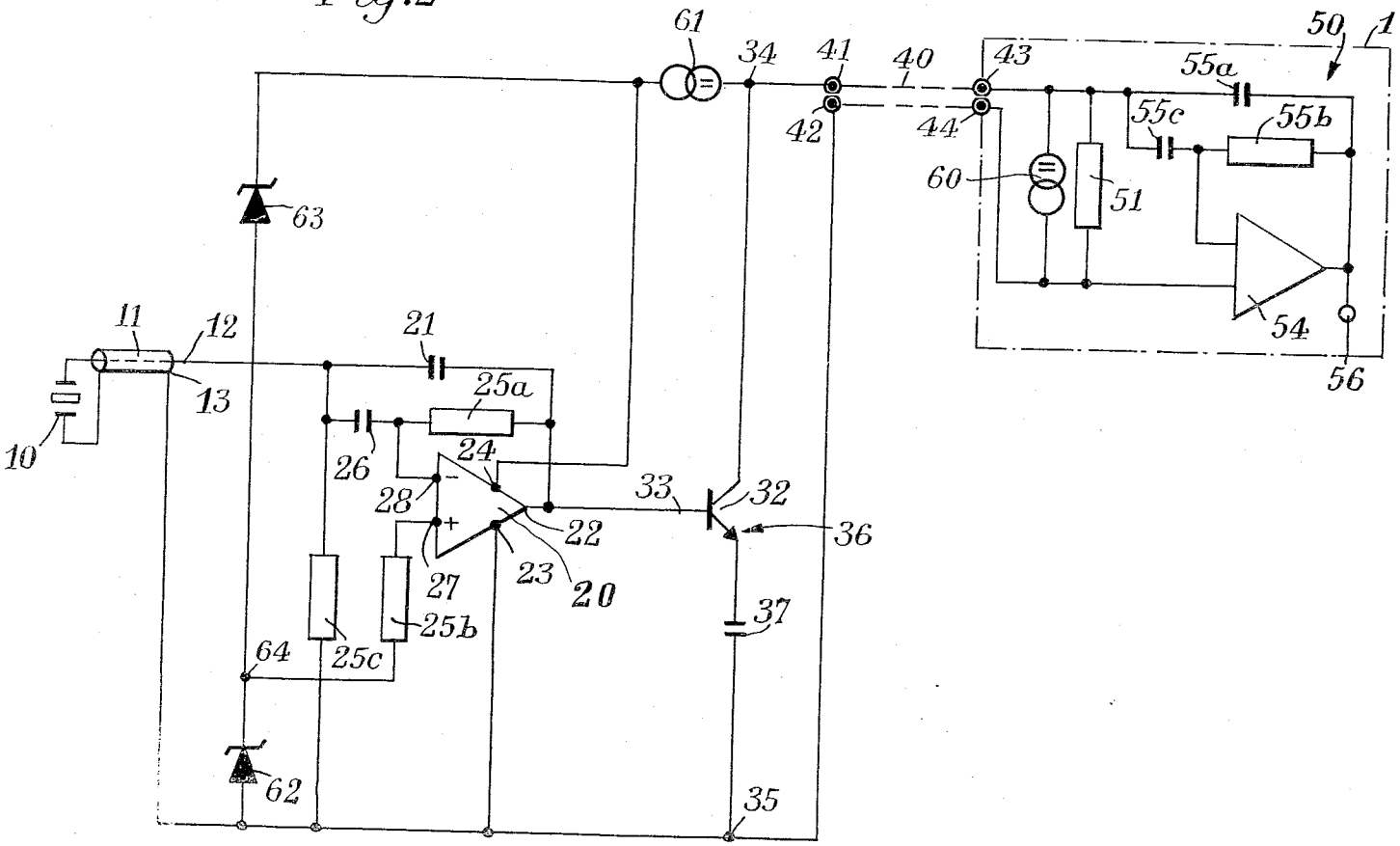
FIG. 2 shows the diagram of the transmission device of the invention, with transmission by electric charge variation.

In FIG. 2, we find some of the elements of FIG. 1, designated by the same reference numbers. FIG. 2 also shows resistors 25*a*–25*b* and 25*c*, and a capacitor 26 for causing preamplifier 20 to operate conventionally as a charge amplifier. Zener diodes 62 and 63 are connected in series to the input terminals 41, 42 of the line 40 and provide an intermediate voltage point 64 connected through resistor 25*b* to a positive input terminal 27 of preamplifier 20.

An output terminal 12 of cable 11 is connected through a capacitor 26 to a negative input terminal 28 of preamplifier 20, to which a feedback resistor 25*a* is also connected. The other output terminal 13 of cable 11 could have been connected to point 64. It is however preferred to connect terminal 13 to terminals 23, 35 and 42, so as to have a common ground between cable 11 and transmission line 40.

It can be seen in FIG. 2 that line 40 is formed by two conductors which are not screened.

According to the invention, the preamplified signal is transformed by an electronic circuit 36 comprising a transistor 32, of which the collector-emitter path is in series with a capacitor 37. The base terminal 33 of said transistor 32, forming the input of the electronic circuit 36, is connected to the output 22 of preamplifier 20. The endmost terminals 34 and 35 of the transistor 32 and capacitor 37 assembly are respectively connected to first input terminal 41 and second input terminal 42 of transmission line 40.

It can be seen that circuit 36 operates as an electric charge generator generating an electric charge or amount of electricity algebraically proportional to the preamplified signal received at its input 33.

In FIG. 2, it can also be seen that the electronic measuring circuit 50, located in the measurement room 1, comprises an amplifier 54 connected in a known manner as a charge amplifier by means of a charge capacitor 55*a*. A feedback resistor 55*b*, a coupling capacitor 55*c* and load resistor 51 complete circuit 50. The output signal is available at terminal 56.

As viewed from output terminals 43–44 of the line 40, capacitor 55*a* has a capacity C multiplied by the gain a of amplifier 54, so that if q is a charge generated by the charge generator 36, said charge is transferred to capacitor 55*a* with a very small voltage variation v such that:

$$v = q/(a.C)$$

It can be seen that the possible parasitic capacitance of the line 40 has a negligible effect in relation to the high input capacitance a.C of the electronic measuring circuit 50.

In FIG. 2, it can also be seen that the constant current generator 60 is provided as in the case of FIG. 1. However, in relation to FIG. 1 a constant DC current absorber 61 has been added and inserted between the supply terminal 24 for preamplifier 20 and the output terminal 34 of the electric charge generator 36, itself connected to the first input terminal 41 of transmission line 40.

The absorber 61 has a high impedance, whereby the charge generated by the charge generator 36 is entirely fed to transmission line 40.

Figure 3:
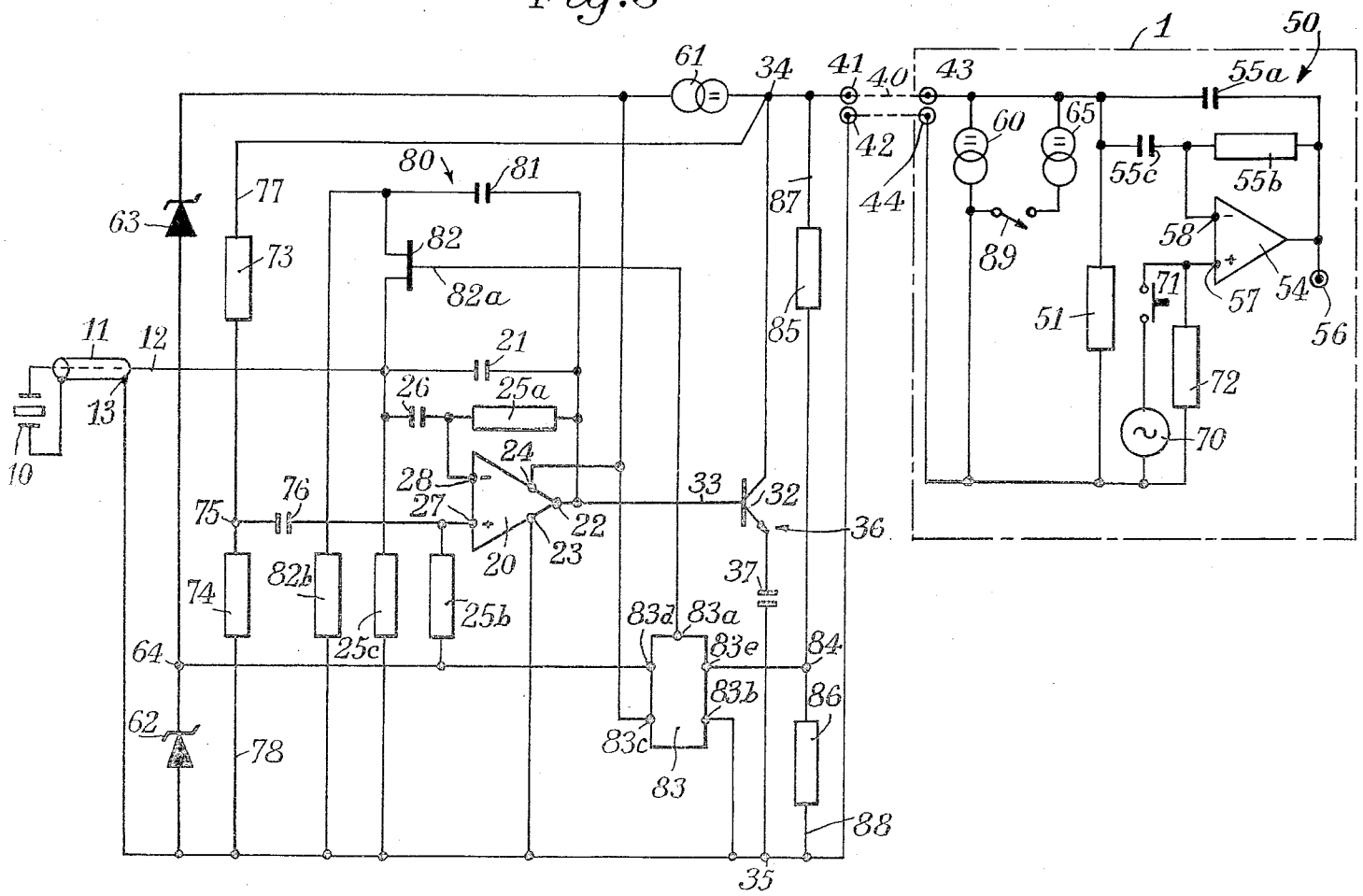
FIG. 3 shows the transmission device of FIG. 2, completed by a checking circuit and a gain modification circuit.

FIG. 3 contains elements already described above and shown in FIG. 2. There has however been added the test alternating voltage source 70, with its test switch 71. But instead of being located adjacent to the preamplifier 20 as in FIG. 1, source 70 and switch 71 are located in the measurement room 1 and are connected to a positive input terminal 57 of amplifier 54, in parallel with a resistor 72. A negative input terminal 58 of amplifier 54, at which the feedback takes place, is connected by capacitor 55*c* to the output terminal 43 of the transmission line 40.

On the other hand, a voltage divider, formed by two resistors 73–74, has a middle point 75 connected by a capacitor 76 to the positive input terminal 27 of preamplifier 20. The endmost terminals 77 and 78 of the divider 73–74 are respectively connected to the input terminals 41 and 42 of transmission line 40.

The fact of applying the test voltage at input terminal 57 not subjected to the feedback does not disturb the measurement which is made by the summing of the current at the input terminal 58, subjected to the feedback, of the amplifier 54. In fact, the impedance existing between input terminals 57 and 58 of the amplifier 54 is very high.

When switch 71 is closed, the test voltage is applied to the transmission line 40 and is to be found partially at the input 27 of preamplifier 20. Since input 27 is not subjected to feedback, the measurement effected at input terminal 28 is not disturbed for the same reason as above.

The checking operation may therefore be carried out without having access to the offset location where the preamplifier is to be found, without requiring an additional transmission line and without disturbing the measurement.

It can be noted that if the above-described arrangements had been applied to a current variation transmission as in the case of FIG. 1 and not to a charge variation transmission as in the case of FIG. 3, the alternating test voltage would have appeared at terminals 41–42 and would have been superimposed on the transmitted signal, which would have disturbed the latter. Furthermore, a voltage divider applying the test voltage at the input of amplifier 20 would also have made a coupling between the input and the output of the amplifier, thereby causing oscillations to be produced by positive feedback.

FIG. 3 shows also a gain modification circuit 80, which comprises a capacitor 81, connected in parallel with capacitor 21 through a control member 82, which may be for example a field effect transistor having a control terminal 82*a* and a bias resistor 82*b*.

The control terminal 82*a* is connected to the output 83*a* of a DC voltage threshold detector 83. The detector 83 is supplied with power through terminals 83*b*–83*c* connected respectively to the supply terminals 23–24 of preamplifier 20. An input terminal 83*d* of detector 83 receives a reference voltage such as the one appearing at the common point 64 of the Zener diodes, whereas another input terminal 83*e* receives a voltage having a threshold to be detected.

The input terminal 83*e* is connected to the middle point 84 of a voltage divider comprising two resistors 85–86 of which the endmost terminals 87–88 are connected respectively to the input terminals 41–42 of the transmission line 40.

Furthermore, a switch 89, situated in the measurement room 1, allows the output of the constant DC current generator 60 to be modified. In the example shown in FIG. 3, switch 89 connects, when closed, a second generator 65 in parallel with the first generator 60, but it could also have been arranged to modify the output of generator 60. The respective outputs of generators 60 and 65 are chosen so that the output of generator 60 alone provides at the middle point 84 of the voltage divider 85–86 a voltage not causing the operation of the threshold detector 83, whereas the total output of both generators 60 and 65 causes the operation of said detector 83. Thus, we have a means for modifying the gain of the preamplifier 20 from the measurement room 1, without requiring any additional transmission line.

Such output modifications do not upset the supply circuit for the preamplifier 20 because of the insertion of the constant DC current absorber 61 in the supply circuit.

It can be noted that the load resistor 51 must have a higher value than in the case of FIG. 2, so as to take into consideration the resistances of dividers 73–74 and 85–86.

Figure 4:
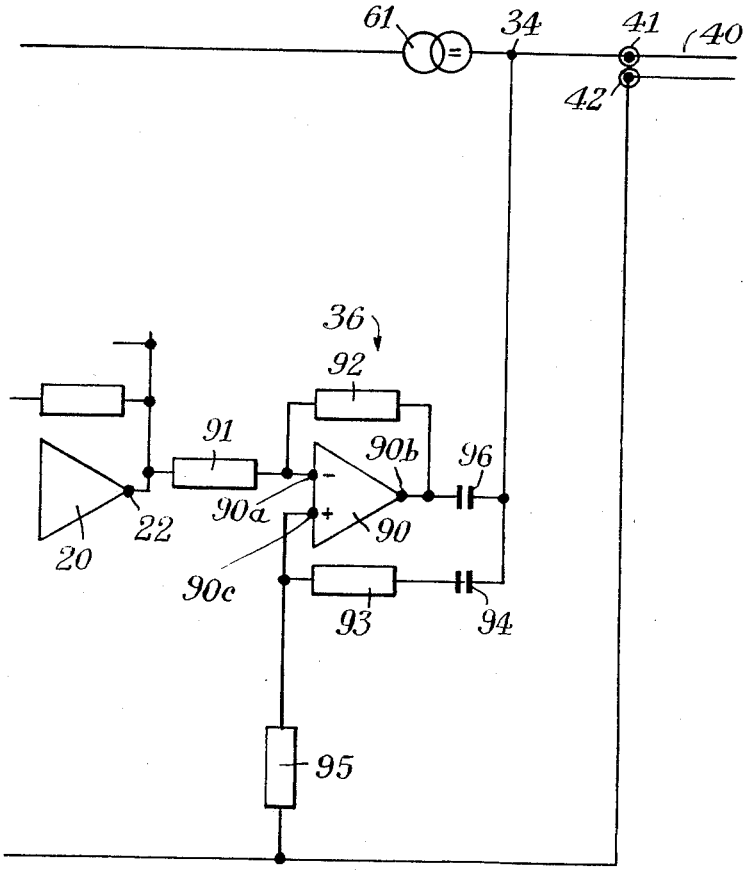
FIG. 4 shows another embodiment of the electric charge generator forming part of the device of FIG. 2.

The charge generator 36 shown in FIG. 4 comprises an operational amplifier 90 having a negative input 90*a* connected through a resistor 91 to the output 22 of the preamplifier 20, a positive input 90*c* connected, on the one hand, through a resistor 93 in series with a capacitor 94, to the input terminal 41 of the transmission line 40 and, on the other hand, through a resistor 95, to the input terminal 42 of transmission line 40, and an output 90*b* connected, on the one hand, through a feedback resistor 92, to the negative input terminal 90*a* of the operational amplifier 90 and, on the other hand, through a capacitor 96, to the input terminal 41 of transmission line 40.

Capacitor 94 prevents the DC supply current from passing into resistors 93 and 95.

Capacitor 96 acts as capacitor 37 of the simplified charge generator shown in FIG. 3.

The arrangement of FIG. 4 allows a greater accuracy to be obtained in the measurement, the gain of amplifier 90 being considerably greater than that of a simple transistor.

Of course, it is possible to make many modifications to the device described above, without departing from the spirit of the invention.

By way of example, a single voltage divider can be substituted for the voltage dividers 73–74 and 85–86.

The sensor 10 can also be a strain gauge, or the signal from the sensor 10 could be continuous by nature, as in a thermocouple, but artificially modulated before its introduction into the charge generator.

What is claimed is:

1. In a device for transmitting an alternating analog signal from a sensor to a measurement room remote from the sensor, comprising a measuring preamplifier located in the vicinity of the sensor for providing a preamplified signal from the analog signal of the sensor, a transmission line having two conductors for conveying the preamplified signal to the measurement room, an electronic measuring circuit located in the measurement room and receiving the transmitted preamplified signal for providing an output signal representing the signal from the sensor, and a power supply circuit located in the measurement room and comprising a constant DC current generator connected to supply terminals of the measuring preamplifier through the transmission line, the improvement consisting in that an electric charge generator is inserted between the preamplifier and the transmission line for generating an electric charge proportional to the preamplified signal received at its input, and the electronic measuring circuit comprises an electric charge amplifier.

2. The device as claimed in claim 1, wherein a constant DC current absorber is inserted between a supply terminal of the pre-amplifier and an output terminal of the electric charge generator, itself connected to an input terminal of the transmission line.

3. The device as claimed in claim 2, further comprising a circuit for modifying the gain of the preamplifier, said preamplifier having a feedback capacitor connected between its output and input thereof, and said gain modifying circuit comprising an additional feedback capacitor and a switch means having a control terminal for connecting said additional feedback capacitor in parallel with the feedback capacitor of said preamplifier, wherein a DC voltage threshold detector has an output connected to the control terminal of said switch means, an input connected to a middle point of a voltage divider having endmost terminals connected respectively to input terminals of the transmission line, and wherein a switch, located in the measurement room, is connected to allow the output of the constant DC current generator to be modified so as to have in one position of said switch a DC current not causing the operation of said threshold detector, and in another position of said switch a DC current causing the operation of said threshold detector.

4. The device as claimed in claim 1, wherein the electric charge generator is formed by a circuit comprising the collector-emitter path of a transistor in series with a capacitor, the base terminal of said transistor forming the input of the charge generator and being connected to the output of the preamplifier.

5. The device as claimed in claim 1, wherein the electric charge generator comprises an operational amplifier having a negative input connected through a first resistor to the output of the preamplifier, a positive input connected, on the one hand, through a second resistor in series with a first capacitor, to a first input terminal of the transmission line and, on the other hand, through a third resistor, to a second input terminal of the transmission line, and an output connected, on the one hand, through a feedback resistor to the negative input terminal of the operational amplifier and, on the other hand, through a second capacitor to the first input terminal of the transmission line.

6. The device as claimed in claim 1, further comprising a circuit for checking the proper operation of the transmission chain going from the sensor to the output of the measuring circuit, said checking circuit comprising an alternating voltage source located in the measurement room, and coupling means for applying at least a fraction of the voltage of the alternating voltage source to the input of the preamplifier, the preamplifier and the charge amplifier each having one input terminal subjected to feedback and another input terminal not subjected to feedback, wherein said alternating voltage source is connected through a test switch to said other input terminal of the charge amplifier (54) not subjected to feedback, and wherein said coupling means comprise a voltage divider having a middle point connected through a capacitor to said others input terminal of the preamplifier not subjected to feedback, and endmost terminals of said voltage divider being connected respectively to input terminals of the transmission line.

* * * * *